United States Patent [19]

Frost, Jr.

[11] 4,123,232

[45] Oct. 31, 1978

[54] POUR POINT DEPRESSANTS

[75] Inventor: Kenneth A. Frost, Jr., San Rafael, Calif.

[73] Assignee: Chevron Research Company, San Francisco, Calif.

[21] Appl. No.: 811,236

[22] Filed: Jun. 29, 1977

[51] Int. Cl.[2] ..... C10L 1/22

[52] U.S. Cl. ..... 44/72

[58] Field of Search ..... 260/584 B, 584 R, 584 C; 44/72

[56] References Cited

U.S. PATENT DOCUMENTS

| | | | |
|---|---|---|---|
| 2,856,363 | 10/1958 | Brennan | 260/584 B |
| 3,092,475 | 6/1963 | Cole et al. | 44/72 |
| 3,317,609 | 5/1967 | Lesesne | 260/584 B |
| 4,049,557 | 9/1977 | Wixon | 260/584 B |

*Primary Examiner*—Winston A. Douglas
*Assistant Examiner*—Y. Harris-Smith
*Attorney, Agent, or Firm*—D. A. Newell; C. J. Tonkin; J. J. DeYoung

[57] ABSTRACT

Pour point depressants for hydrocarbonaceous fuels and oils are prepared by reacting an epoxidized alpha-olefin with a nitrogen-containing compound selected from an amine, a polyamine or a hydroxyamine.

8 Claims, No Drawings

POUR POINT DEPRESSANTS

FIELD OF THE INVENTION

This invention relates to new materials which are useful as pour point depressants for hydrocarbonaceous fuels and oils.

BACKGROUND OF THE INVENTION

When using liquid hydrocarbons as lubricating oils or fuels, it is necessary that the hydrocarbon fluids flow readily at low temperatures, especially at temperatures below the freezing point of water (0° C.). The flow of these fluids, particularly those with high wax content, is very sensitive to low temperatures. At low temperature when the wax crystallizes, the fluid sets up as a waxy material and does not pour. The pour point depressant additives do not reduce the amount of wax which crystallizes from the fluids, but rather modify their surface by absorption or co-crystallization. This reduces the fluid occlusion by the crystals and changes the wax crystal structure, thus permitting the fluid to flow.

Major types of materials that have found wide acceptance as pour point depressants are naphthylene alkylated with chlorinated waxes and homo- or copolymers of hydrocarbon olefins, methacrylates, vinyl esters and alkyl styrene.

SUMMARY OF THE INVENTION

Novel pour point additives for hydrocarbon fuels are prepared by reacting an epoxidized alpha-olefin containing from 14 to 30 carbon atoms and a nitrogen-containing compound selected from an amine $R_2NH$, wherein R contains from 6 to 30 carbon atoms, a polyamine $H_2N—(CH_2CH_2N)_x—CH_2CH_2NH_2$, wherein $x$ is 0 to 4, and a hydroxy amine $HO—(CH_2)_y—NH_2$, wherein $y$ is 1 to 5.

DETAILED DESCRIPTION OF THE INVENTION

The novel additives described above which are used to lower the pour point of distillate fuels are prepared by reacting an epoxidized alpha-olefin containing from 14 to 30 carbon atoms with a nitrogen-containing compound as described above. This reaction is carried out at a temperature from 25° to 250° C., and preferably from 50° to 175° C. The reaction is usually carried out at atmospheric pressure, although higher or lower pressures may be used, if desired.

The molar ratio of the reactants is preferably 1–7 mols of epoxidized alpha-olefin to 1 mol of nitrogen-containing compound, and most preferably from 1 to 5 mols epoxidized alpha-olefin to 1 mol nitrogen-containing compound.

The epoxidized alpha-olefin is prepared by treating an olefin having from 14 to 30 carbon atoms with an epoxidizing agent, such as 40% peracetic acid, perbenzoic acid, m-chloro perbenzoic acid and performic acid. The alpha-olefins are available from many sources, including those made by the Ziegler process and wax cracking.

The amine of the formula $R_2NH$ can be any oil-soluble amine containing from 6 to 30 carbon atoms in each R group. Preferably each R group is aliphatic, and most preferably each R group is derived from tallow.

The polyamines useful in preparing the pour point depressant of this invention are the well-known ethylene amines, specifically ethylene diamine, diethylene triamine, triethylene tetraamine, tetraethylene pentamine and pentaethylene hexamine. These compounds are usually prepared by the reaction of an alkylene chloride with ammonia. This reaction yields a somewhat complex mixture of alkylene amines, including some cyclic condensation products. These mixtures are also useful in the process of this invention and are included within the scope of the term "polyamine".

The hydroxy amines used to prepare the compounds of this invention are alkylene amines having 1 hydroxyalkyl substituent of a nitrogen atom. The preferred hydroxyalkylamine of this invention is ethanol amine.

The pour point depressants of this invention may be used with a variety of hydrocarbon fuels which require the lowering of their pour points. The compositions of this invention are particularly useful with mid-range distillate fuels.

Both naturally derived and synthetic hydrocarbon fuels may be used in conjunction with the pour point depressant compositions of this invention. Naturally derived oils include naphthenic, paraffinic, asphaltic or mixed base oils which may be waxy or partially dewaxed. Synthetic oils may be derived by polymerization of olefins, generally in the range from $C_6$–$C_{12}$.

The pour point depressants of this invention are particularly useful with diesel fuels obtained from cracked light cycle oil. Cracked light cycle oils generally have boiling ranges in the range of 300° F. to 700° F. (ASTM D-158-54).

Usually at least 100 parts per million or more of the point point depressant composition will be used. Generally the amount of pour point depressant used will be less than about 2 weight percent, and generally less than about 1 weight percent of the hydrocarbon fluid. However, up to 10,000 parts per million or more of the point point depressants may be necessary for certain types of fuels.

The pour point depressant compositions may be used in the presence of various other additives which are common to compounded fuels. In addition to pour point depressants, there may be present rust inhibitors, oiliness agents, dyes, detergents, etc. Usually these other additives will be present in amounts of from about 10 parts per million to 10 weight percent.

EXAMPLES

The following examples are offered by way of illustration of the invention.

EXAMPLE 1

(a) To a 200-ml flask with stirring is added 20 g (0.088 mol) of a $C_{14}$–$C_{16}$ alpha-olefin oxide and 23 g (0.22 mol) of diethylene triamine. The reaction mixture is heated to 150° C. for 4 hours to yield a product having a molecular weight of 788 and 4.08 to 4.15% nitrogen.

(b) 20 g (0.079 mol) of a $C_{15}$–$C_{20}$ alpha-olefin oxide and 2.03 g (0.020 mol) of diethylene triamine are reacted to yield a product having a molecular weight of 533 and containing 4.09% nitrogen.

(c) 20 g (0.071 mol) of a $C_{18}$–$C_{20}$ alpha-olefin oxide is reacted with 1.03 g (0.018 mol) of diethylene triamine to yield a product having a molecular weight of 714 and containing 3.79% nitrogen.

EXAMPLE 2

(a) To a 100-ml flask is added 1.79 g (0.029 mol) ethanolamine and 20 ml toluene. The mixture is heated to 80° C. and then 20 g (0.088 mol) of a $C_{14}$–$C_{16}$ alpha-olefin oxide is added dropwise. The mixture is heated to reflux and stirred for 4 hours to yield a product having a molecular weight of 425 and containing 1.85% nitrogen.

(b) 1.61 g (0.026 mol) of ethanolamine in 20 ml toluene is reacted with 20 g (0.079 mol) of a $C_{15}$–$C_{20}$ alpha-olefin oxide to yield a product having a molecular weight of 526 and containing 1.76% nitrogen.

(c) 1.44 g (0.025 mol) ethanolamine in 20 ml toluene is reacted with 20 g (0.071 mol) of a $C_{18}$–$C_{20}$ alpha-olefin oxide to yield a product having a molecular weight of 588 and containing 1.53% nitrogen.

EXAMPLE 3

To 40 g (0.079 mol) of ditallow amine at 175° C. is added dropwise 20 g (0.079 mol) of a $C_{15}$–$C_{20}$ alpha-olefin oxide. The reaction mixture is stirred for 6 hours, cooled, diluted with hexane and then washed 3 times with 150 ml water. The mixture is dried and filtered and then cooled over ice to give a solid. Solvent is removed from the product to yield 39.5 g having a molecular weight of 614 and containing 2.00% nitrogen.

EXAMPLE 4

To a 200-ml flask with stirring under nitrogen is added 50.8 g (0.20 mol) of a $C_{15}$–$C_{20}$ alpha-olefin oxide and 4.0 g (0.066 mol) of ethylene diamine. The reaction mixture is heated to 150° C. for 2½ hours to yield a product having a molecular weight of 842 and containing 5.53% nitrogen.

EXAMPLE 5

The pour point depressant effect of the additives of this invention was determined for a variety of fuels according to ASTM D-97-57. The results of these tests are illustrated in Table I.

TABLE I

| Pour Point Improver | Fuel | Pour Point, ° F |
|---|---|---|
| None | (1) | 15 |
| 500 ppm product of Ex. 4 | (1) | 0 |
| 1000 ppm product of Ex. 4 | (1) | −35 |
| None | (2) | 10 |
| 500 ppm product of Ex. 3 | (2) | 5 |
| 1000 ppm product of Ex. 3 | (2) | <−40[1] |
| None | (2) | 15 |
| 500 ppm product of Ex. 1 (b) | (2) | −10 |
| 1000 ppm product of Ex. 1 (b) | (2) | −25 |
| 500 ppm product of Ex. 2 (b) | (2) | −10 |

TABLE I-continued

| Pour Point Improver | Fuel | Pour Point, ° F |
|---|---|---|
| 1000 ppm product of Ex. 2 (b) | (2) | −35 |

(1) Perth Amboy heating
(2) Richmond No. 2
[1]The symbol < means "less than".

As will be evident to those skilled in the art, various modifications of this invention can be made in light of the foregoing disclosure and discussion without departing from the spirit or scope of the disclosure or from the scope of the following claims.

What is claimed is:

1. A fuel composition comprising a distillate fuel and a pour-point depressant amount of a material consisting essentially of the reaction product of (1) an epoxidized alpha-olefin containing from 14 to 30 carbon atoms, and (2) a nitrogen-containing compound selected from an amine $R_2NH$ wherein R contains from 6 to 30 carbon atoms, a polyamine $H_2N—(CH_2CH_2N)_x—CH_2CH_2—NH_2$ wherein $x$ is 0 to 4, and a hydroxyalkylamine $HO—(CH_2)_y—NH_2$ wherein $y$ is 1 to 5.

2. The composition of claim 1 wherein the epoxidized alpha-olefin contains 14 to 20 carbon atoms.

3. The composition according to claim 2 wherein the nitrogen-containing compound is an amine wherein R is alkyl or alkenyl containing for 16 to 18 carbon atoms.

4. The composition according to claim 3 wherein the nitrogen-containing compound is ditallow amine, ethylene diamine, diethylenetriamine, or ethanolamine.

5. A method for lowering the pour points of fuels which comprises adding a pour-point depressant amount of a material consisting essentially of the reaction product of (1) an epoxidized alpha-olefin containing from 14 to 30 carbon atoms, and (2) a nitrogen-containing compound selected from an amine $R_2NH$ wherein R contains from 6 to 30 carbon atoms, a polyamine $H_2N—(CH_2CH_2N)_x—CH_2CH_2—NH_2$ wherein $x$ is 0 to 4, and a hydroxyalkylamine $HO—(CH_2)_y—NH_2$ wherein $y$ is 1 to 5.

6. The method according to claim 5 wherein the epoxidized alpha-olefin contains 14 to 20 carbon atoms.

7. The method according to claim 6 wherein the nitrogen-containing compound is an amine wherein R is an alkyl or alkenyl group containing from 16 to 18 carbon atoms.

8. The method according to claim 7 wherein the nitrogen-containing compound is ditallow amine, ethylene diamine, diethylenetriamine, or ethanolamine.

* * * * *